US006740857B1

(12) United States Patent
Furlong et al.

(10) Patent No.: US 6,740,857 B1
(45) Date of Patent: May 25, 2004

(54) CARTRIDGE HEATER WITH MOISTURE RESISTANT SEAL AND METHOD OF MANUFACTURING SAME

(75) Inventors: Sidney L. Furlong, Odgen, UT (US); Amy M. Barker, Odgen, UT (US); Sam W. Henry, Odgen, UT (US)

(73) Assignee: Chromalox, Inc., Pittsburgh, PA (US)

( * ) Notice: Subject to any disclaimer, the term of this patent is extended or adjusted under 35 U.S.C. 154(b) by 0 days.

(21) Appl. No.: 10/313,521

(22) Filed: Dec. 6, 2002

(51) Int. Cl.[7] ..... H05B 3/44
(52) U.S. Cl. ..... 219/544; 219/542; 219/541
(58) Field of Search ..... 219/544, 542, 219/541, 552, 534; 338/240, 301; 392/497; 29/615, 611

(56) References Cited

U.S. PATENT DOCUMENTS 4,314,401 A * 2/1982 Saku ..... 29/611
4,433,198 A * 2/1984 Berner et al. ..... 136/230
5,066,852 A 11/1991 Willbanks
5,095,193 A 3/1992 Doyle
5,486,682 A 1/1996 Rysemus
5,872,890 A 2/1999 LaCombe
6,172,345 B1 1/2001 Dial et al.

* cited by examiner

*Primary Examiner*—Edward K. Look
*Assistant Examiner*—Vinod D. Patel
(74) *Attorney, Agent, or Firm*—Kirkpatrick & Lockhart LLP

(57) ABSTRACT

A cartridge heater and method of manufacturing same. In one embodiment, the cartridge includes a sheath having a first end and a second end. The first end of the sheath forms a seat. An elastomeric bushing is swaged against the seat such that it forms a mechanically bonded seal substantially preventing moisture egress into the cartridge heater. A heating element is also disposed in the sheath and is connected to leads protruding from the bushing. The heater includes crushable insulation material disposed within the sheath.

13 Claims, 3 Drawing Sheets

CARTRIDGE HEATER WITH MOISTURE RESISTANT SEAL AND METHOD OF MANUFACTURING SAME

BACKGROUND OF THE INVENTION

Various configurations of electric cartridge heaters are known in the prior art. A typical cartridge heater includes a metal sheath around a resistance-wire heating element coiled around a core of insulating material. An insulating filler material with appropriate thermal conductivity and electrical insulating properties is used to fill the space between the coil and the sheath. Granulated magnesium oxide is typically used as the insulating filler material. After the sheath is filled, the sheath is subjected to compression forces, for example, by swaging. Compression compacts the granulated magnesium oxide and improves its dielectric and thermal conductivity properties. Lead wires may be attached to the coil before or after filling the sheath and may be held in place with an end plug made of materials such as Teflon, mica and silicone rubber. The lead wires become secured within the plug after swaging. The lead wires may then be potted with sealants to provide moisture resistance. Depending upon the intended application, cartridge heaters of varying sizes and voltage ratings may be required. U.S. Pat. No. 6,172,345, for example, discloses a high voltage cartridge heater which includes a core sleeve of pre-compacted insulating material.

With current manufacturing technology, it has proven to be a challenge to reliably produce high-voltage cartridge heaters for high moisture environments. Heaters in operation in high moisture environments are prone to dielectric breakdown and current leakage problems caused by the egress of moisture and water into the dielectric insulating material. In high moisture environments, dielectric integrity and current leakage must be kept within predetermined limits in order for the cartridge to meet certain industry standards, such as those standards established by Underwriters Laboratories, for example, the UL 471 standards.

One apparent reason for such problems is that the potting sealants and sealant methods used to seal the lead wire end of the cartridge do not provide adequate bonding with the lead wires and the sheath. Sealant materials, such as epoxy and silicone, for example, do not bond adequately with the stainless steel used for the construction of the sheath or with the silicone-coated lead wires. As a result, high-voltage cartridge heaters are traditionally only offered with sealants that do not qualify for certification for high moisture environments under the applicable industry standards.

SUMMARY

One embodiment of the invention provides a cartridge heater. The cartridge includes a sheath having a first end and a second end. The first end of the sheath forms a seat. An elastomeric bushing is swaged against the seat such that it forms a mechanically bonded seal substantially preventing moisture egress into the cartridge heater. A heating element is also disposed in the sheath and is connected to leads protruding from the bushing. The heater may include crushable insulation material disposed within the sheath.

BRIEF DESCRIPTION OF THE DRAWINGS

In the accompanying Figures, there are shown present embodiments of the invention wherein like reference numerals are employed to designate like parts and wherein.

DETAILED DESCRIPTION OF THE INVENTION

Figure 1:
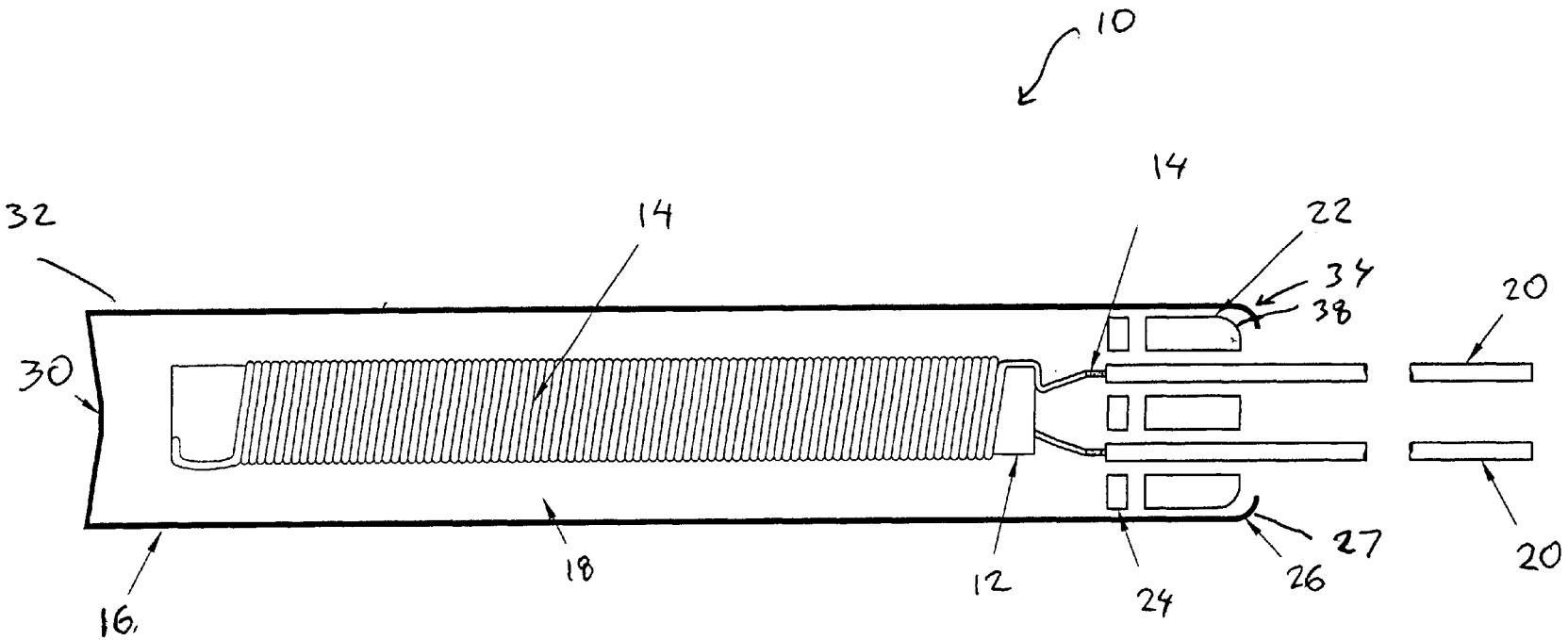
FIG. 1 is a sectional view of an embodiment of cartridge heater according to the present invention.

Referring now to the drawings for the purpose of illustrating the invention and not for the purpose of limiting the same, it is to be understood that standard components or features that are within the purview of an artisan of ordinary skill and do not contribute to the understanding of the various embodiments of the invention are omitted from the drawings to enhance clarity. In addition, it will be appreciated that the characterizations of various components and orientations described herein as being "vertical" or "horizontal", "right" or "left", "side", "top" or "bottom", are relative characterizations only based upon the particular position or orientation of a given component for a particular application.

FIG. 1 shows a side cross-sectional view of a cartridge heater 10 in accordance with one embodiment of the invention. In the embodiment of FIG. 1, the heater 10 may include an elongate heater element wind core 12 about which a resistive heating element wire 14 may be coiled, in an essentially conventional configuration. The wind core 12 may be made of magnesium oxide, and is substantially cylindrical. The wind core 12 and the coiled wire 14 are disposed within an outer sheath 16 made of, for example, stainless steel or the like. Interposed between the inner diameter of the sheath 16 and the heating element 14 is an electrically insulating, thermally conducting material 18 (hereinafter "insulating material"). The insulating material 18 may be composed of loose-fill or pre-compacted magnesium oxide.

Figures 2A, 2B, 2C:
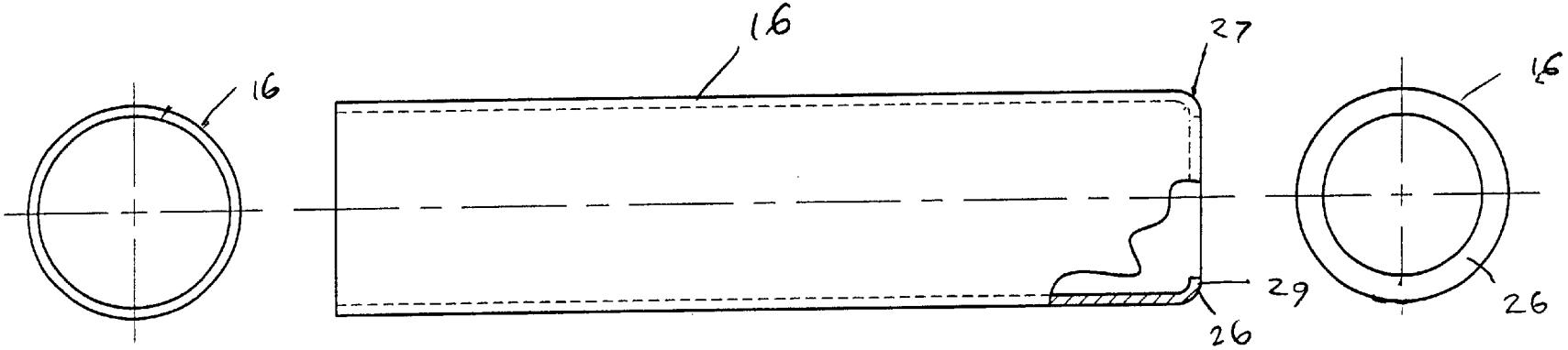
FIG. 2*a* is a rear view of an embodiment of a sheath for the cartridge heater of FIG. 1.
FIG. 2*b* is a side view of the sheath of FIG. 2*a;*
FIG. 2*c* is a front view of the sheath of FIG. 2*a;*

The sheath 16 may be a tube that has a first end 32 and a second end 34. An annular seat 26 is formed at the second end 34 of the sheath 16 prior to assembly by spin over or other conventional forming means. See FIGS. 2*a*–2*c*. The seat 26 extends from the second end 34 of the sheath 16 and is curved 90° relative to the sheath 16 through a curved portion 27 to form an annular planar surface 29. The inner radius of the curved portion 27 of the seat 26 may be, for example, 1/32 of an inch and the outer radius 1/16 of an inch. The corresponding thickness of the sheath may be 0.028 inches.

Figure 3B:
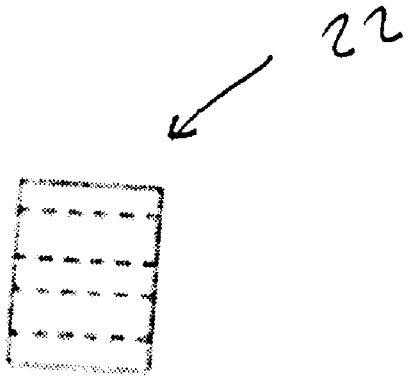
FIG. 3*b* is a side view of one embodiment of a seal bushing for the cartridge heater of FIG. 1.
Figure 3A:
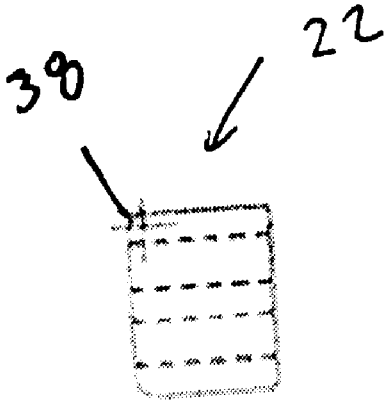
FIG. 3*a* is a side view of one embodiment of a seal bushing for the cartridge heater of FIG. 1.

Operating power is supplied to cartridge heater 10 by means of two supply (lead) wires 20. The wires 20 may 18-gauge, silicone rubber-coated wire rated to conduct on the order of 600 volts. The wires 20 enter the second end 34 of heater 10 through a seal bushing 22 and a mica disk 24 each having appropriately sized through-holes formed therein. The seal bushing 22 may be made of elastomeric or rubber-like material. For example, a fluorocarbon elastomer, such as the commercially available Viton® with Shore A durometer in the range of 70–80 may be used. A nitrile elastomer, such as BUNA N with Shore A durometer in the range of 65–75 may be also used. The seal bushing 22 may have a rounded edge 38 conforming to the curved portion 27 of the seat 34, as shown in FIGS. 1 and 3*a,* or it may have straight edges as shown in FIG. 3*b*.

In the embodiment of FIG. 1, the sheath 16 may be approximately four inches long, and may have an outer diameter of one-half inch or less. The core 14 may have a length of approximately three and one half inches. The seal bushing 22 has a diameter which is equal to the inner diameter of the sheath 16 before swaging, approximately 7/16 of an inch. The axial dimension (length) of the seal bushing may be approximately half an inch or less.

The cartridge heater 10 may assembled as follows: The sheath 16 is cut to length with allowance for the material that will become the seat 26. The seat 26 is mechanically formed in the sheath 16 by conventional methods such as spin over, lathe machining, peening, or die forming, etc. The various components of the heater 10 are inserted into the sheath 16 from its second end 34. Once all of the components are assembled within sheath 16, granular magnesium oxide is introduced into the second end 34 of sheath 16, in order to fill all remaining voids therein to the extent possible. Next, an end cap 30 is welded over the second end 34. Finally, the entire assembly is swaged, for example at a pressure of approximately 200,000 lbs per linear inch, to compress and reduce the overall diameter of the sheath 16. This swaging process compacts the magnesium oxide, thereby enhancing the dielectric and thermal conductive properties of the heater 10. Swaging also compresses the radius of the seal bushing 22 and compresses the seal bushing 22 into the formed seat 26.

The swaged seal bushing 22 forms a mechanical bond with the seat 26 and the lead wires 20 such that moisture is substantially prevented from entering into the cartridge heater 10, when the heater 10 operates in moist locations. Such moisture prevention is achieved through the swaging of the elastomeric seal bushing 22 against the seat 26 without the need to use of any chemical sealants, such as epoxy, silicone or other cementing material, which could limit the versatility of the heater 10 by restricting operability of the heater at certain temperature.

Tests conducted by the independent Underwriters Laboratories (UL) showed that the heater 10 meets the standards established for Commercial Refrigerators and Freezers, UL 471, $8^{th}$ Edition for moist locations. A moist location is defined as a location in which the heater is exposed to moisture but is not subject to more than occasional contact with water in a refrigerator. The test is conducted by operating the heater for 1000 cycles at a rate of 1½ minutes on 13½ minutes off in an atmosphere of not less than 98% humidity at any convenient temperature above 0° C. (32° F.). A seal for a cartridge heater that demonstrably passes this test is defined herein as a seal that substantially prevents moisture egress into the heater. The heater 10 was also certified by UL for operation up to 190° C. temperature in the bushing. On the contrary, prior art epoxy seals are limited to 90° C. and Teflon seals are limited to temperatures of 150° C.

Whereas particular embodiments of the invention have been described herein for the purpose of illustrating the invention and not for the purpose of limiting the same, it will be appreciated by those of ordinary skill in the art that numerous variations of the details, materials and arrangement of parts may be made within the principle and scope of the invention without departing from the spirit of the invention. The preceding description, therefore, is not meant to limit the scope of the invention. Rather the scope of the invention is to be determined only by the appended claims and their equivalents.

What is claimed is:

1. A cartridge heater comprising:

a sheath having a first end and a second end, the first end forming a seat;

an elastomeric bushing swaged against the seat such that it forms a mechanically bonded seal substantially preventing moisture entry into the cartridge heater;

a heating element disposed in the sheath and connected to leads internally with respect to the seal, the leads extending through and protruding from the bushing, the leads including an insulated coating mechanically bonded to the swaged bushing; and crushable insulation material disposed within the sheath.

2. The cartridge heater of claim 1 wherein the bushing comprises fluorocarbon.

3. The cartridge heater of claim 2 wherein the bushing has a durometer in the range of 70–80.

4. The cartridge heater of claim 1 wherein the bushing comprises nitrile.

5. The cartridge heater of claim 4 wherein the bushing has durometer in the range of 65–75.

6. The cartridge heater of claim 1, further comprising a pre-compacted insulation sleeve disposed between the sheath and the heating element.

7. The cartridge heater of claim 1, wherein substantially preventing moisture egress includes withstanding 98% humidity.

8. The cartridge heater of claim 1, wherein the seat has a curved portion and an annular portion, the annular portion being planar.

9. The cartridge heater of claim 8, wherein the bushing has a curved portion conforming with the curved portion of the seat.

10. The method of claim 8, wherein substantially preventing moisture egress includes withstanding 98% humidity.

11. A method of manufacturing a cartridge heater, the method comprising:

forming a seat at one end of a tubular sheath;

installing an elastomeric bushing at the end of the sheath behind the seat;

inserting into the sheath a heating element connected to leads internally with respect to the bushing, the leads passing through the bushing and including an insulated coating;

filling the sheath with insulation material; and swaging the cartridge heater such that the bushing is compacted against the seat and the insulated coating forming a seal substantially preventing moisture entry into the cartridge heater.

12. The method of claim 11, wherein the bushing comprises fluorocarbon.

13. The method of claim 11, wherein the bushing comprises nitrile.

* * * * *

UNITED STATES PATENT AND TRADEMARK OFFICE

CERTIFICATE OF CORRECTION

PATENT NO. : 6,740,857 B1 
DATED : May 25, 2004
INVENTOR(S) : Sidney L. Furlong, Amy M. Barker and Sam W. Henry It is certified that error appears in the above-identified patent and that said Letters Patent is hereby corrected as shown below:

Column 2,
Line 52, delete “may” and substitute therefor -- may be --.

Column 3,
Line 7, delete “may” and substitue therefor -- may be --.
Line 32, delete “to use of any” and substitute therefor -- the use of any --.
Line 35, delete “heater at certain temperature” and substitute therefor -- heater at certain temperatures --.

Signed and Sealed this

Ninth Day of November, 2004

JON W. DUDAS
*Director of the United States Patent and Trademark Office*